United States Patent [19]

Kobayashi et al.

[11] 4,369,350

[45] Jan. 18, 1983

[54] ELECTRIC DEFROSTER HEATER MOUNTING ARRANGEMENT FOR STACKED FINNED REFRIGERATION EVAPORATOR

[75] Inventors: Nobuyuki Kobayashi, Ohiramachi; Taisei Hosoda, Katsuta; Hideo Uzuhashi, Ohiramachi; Tamio Innami, Tsuchiura; Humito Uzuhasi, Yokohama, all of Japan

[73] Assignee: Hitachi, Ltd., Tokyo, Japan

[21] Appl. No.: 131,172

[22] Filed: Mar. 17, 1980

[30] Foreign Application Priority Data

Nov. 29, 1978 [JP] Japan ..... 53-146461

[51] Int. Cl.[3] ..... F25D 21/08; H05B 3/02

[52] U.S. Cl. ..... 219/201; 62/276; 219/341; 219/365; 219/530; 219/540

[58] Field of Search ..... 219/341, 365, 301, 200, 219/201, 530, 540; 62/275, 276, 80, 148, 151, 152

[56] References Cited

U.S. PATENT DOCUMENTS 2,492,397 12/1949 Peterson ..... 62/276
2,529,215 11/1950 Hicke ..... 219/540 X
3,099,914 8/1963 De Witt et al. ..... 219/530 X
3,786,227 1/1974 Seipp et al. ..... 219/201
4,152,900 5/1979 Chopra et al. ..... 62/275 X

*Primary Examiner*—A. Bartis
*Attorney, Agent, or Firm*—Antonelli, Terry & Wands

[57] ABSTRACT

A refrigeration evaporator includes a serpentine refrigerant tube having a plurality of finned straight portions connected by unfinned U-shaped connecting portions to form a stacked assembly of side-by-side finned tube arrays. The fins are rectangular and are provided with a J-shaped cut-out at each corner. The J-shaped cut-outs at confronting corners of the fins of each immediately adjacent pair of finned tube arrays define a U-shaped heater receiving space extending the length of the arrays and which clampingly receives an elongated straight portion of a serpentine electric defroster heater in good heat conductive contact with each fin of the immediately adjacent pair of finned tube arrays. Each fin of the stacked assembly has at least two corners in engagement with the heater. The stacked assembly is disposed transversely in a duct having an air inlet and air outlet. The fins nearest the inlet are spaced at a larger interval than those nearest the air outlet to preclude air flow restriction due to greater frost formation on the fins immediately adjacent the inlet.

6 Claims, 11 Drawing Figures

ELECTRIC DEFROSTER HEATER MOUNTING ARRANGEMENT FOR STACKED FINNED REFRIGERATION EVAPORATOR

BACKGROUND OF THE INVENTION

This invention relates to an evaporator of a refrigerating apparatus in which a phenomenon of frost formation tends to occur.

A refrigerating apparatus of the low temperature type used for preserving foodstuffs in cold storage includes an evaporator constituting a part of the refrigeration cycle for causing boiling and evaporation of a refrigerant. The evaporator has a surface temperature of below 0° C. when the refrigerating apparatus is in operation, and there is a tendency of frost formation on the surface of the evaporator as air is cooled. This has made it necessary to provide the refrigerating apparatus with defrosting means in addition to cooling means including a combination of refrigerant tubing and fins. The defrosting means includes a defrosting heater for avoiding a reduction in the amount of cold air and for preventing a reduction in cooling capabilities due to frost formation.

Because of the need to incorporate a defrosting means, an evaporator of a refrigerating apparatus is more complex in overall construction and higher in production cost than an ordinary heat exchanger, and difficulties are encountered in servicing the evaporator due to deterioration of and damage to the heater.

An evaporator of the prior art that has been used popularly will be described by referring to FIGS. 1 and 2. As shown, fins 1 include long fins 1*a* and short fins 1*b* and are formed with U-shaped notches 1*c* for inserting refrigerant tubing and U-shaped notches 1*d* for inserting a heater. The refrigerant tubing 2 is in the form of a serpentine tube, and the heater 3 includes a heater tube 3*a* for enclosing a heater wire 3*b*. 4 designates a duct. In assembling these parts into an evaporator, the long fins 1*a* and short fins 1*b* are arranged alternately in parallel relation in such a manner that the end portions of the fins 1 from which air currents flow into the evaporator are staggered. Then the serpentine refrigerant tubing 2 and heater 3 are inserted in the U-shaped notches 1*c* and U-shaped notches 1*d* respectively, and the assembly is mounted in the duct 4.

A modification of the evaporator shown in FIGS. 1 and 2 that has also been popular in the past will be described by referring to FIGS. 3 and 4. Fins 5 include long fins 5*a* and short fins 5*b* and are formed with collars 5*c* for inserting refrigerant tubing 6 consisting of straight tubes 6*a* and U-shaped tubes 6*b* connected together to form a serpentine tube. A heater generally designated by the reference numeral 7 includes a heater tube 7*a* enclosing a heater wire 7*b*.

In assembling these parts into an evaporator, the long fins 5*a* and short fins 5*b* are arranged in the same manner as described by referring to FIGS. 1 and 2, and the straight tubes 6*a* are inserted in the collars 5*c*. The straight tubes 6*a* are connected together by the U-shaped tubes at opposite ends of the straight tubes 6*a* so that the flow path through the refrigerant tubing 6 is in serpentine form. Then the heater 7 is fitted to the fins 5 on either side of the refrigerant tubing 6, and the assembly is arranged in the duct 4.

The evaporator of the prior art shown in FIGS. 1 and 2 has the disadvantages that the heat transfer area of each fin 1 is greatly reduced because the refrigerant tubing inserting notches 1*c* of a large size are formed therein by stamping, and that there is high contact thermal resistance between the refrigerant tubing 2 and fin 1 due to a reduced area of contact therebetween, thereby impairing the heat transfer function of the fins 1.

In the modification shown in FIGS. 3 and 4, the U-shaped tubes 6*b* are joined to the straight tubes 6*a* by welding. This makes it necessary to perform additional operations manually, and the refrigerant might leak through the welds when the resistance offered to the flow of the refrigerant increases or when the welds are defective or develop corrosion.

In these two types of evaporators, the fins are continuous in their main portions from the end thereof at which air currents flow into the evaporator to the end thereof at which the air currents leave the evaporator, and the fins have a high central value for the heat transfer area. Because of this, temperature boundary layers would develop on the air current exit end of the evaporator, thereby greatly reducing the mean heat transfer rate.

SUMMARY OF THE INVENTION

This invention has as its object the provision of an evaporator of a refrigerating apparatus of high defrosting efficiency, which requires a small number of fabrication steps, which has a high mean heat transfer rate and which is free from the trouble of the leak of refrigerant.

The outstanding characteristics of the present invention are that a multiplicity of fins of a small size are arranged parallel to one another in a plurality of arrays so that the adjacent arrays of fins have different spacing intervals, refrigerant tubing is arranged in the form of a serpentine tube in such a manner that the U-shaped bends of the tubing are disposed outside the arrays of fins, and the fins are each formed with heater supporting cutouts at four corners thereof so that a heater can be supported by the heater supporting cutouts of the adjacent fins in thermal contact therewith.

DESCRIPTION OF THE PREFERRED EMBODIMENT

Figure 1:
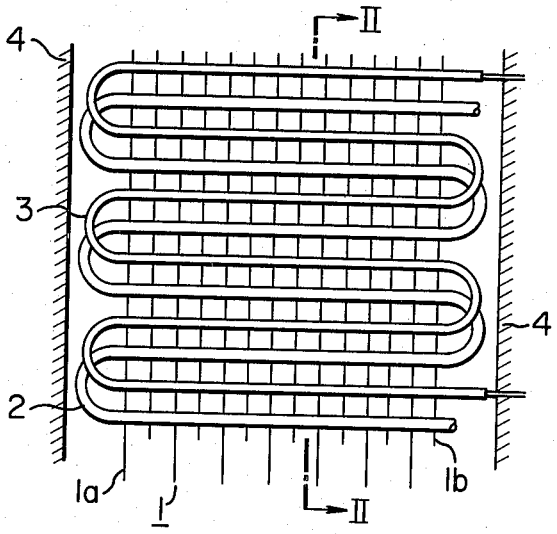
FIG. 1 PRIOR ART
FIG. 1 is a front view of an evaporator of the prior art.
Figure 2:
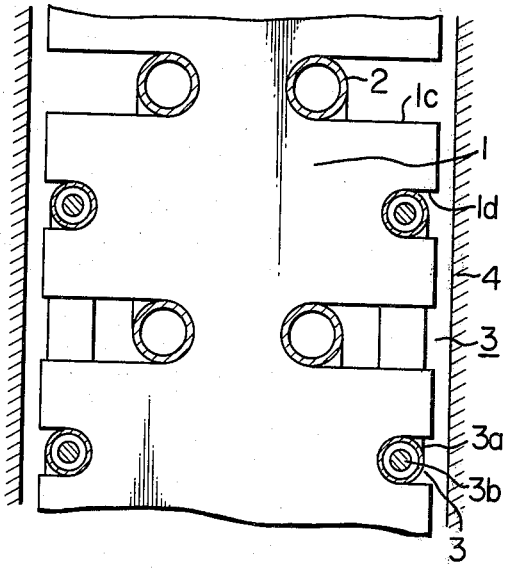
FIG. 2 PRIOR ART
FIG. 2 is a fragmentary sectional view, on an enlarged scale, taken along the line II—II in FIG. 1.
Figure 3:
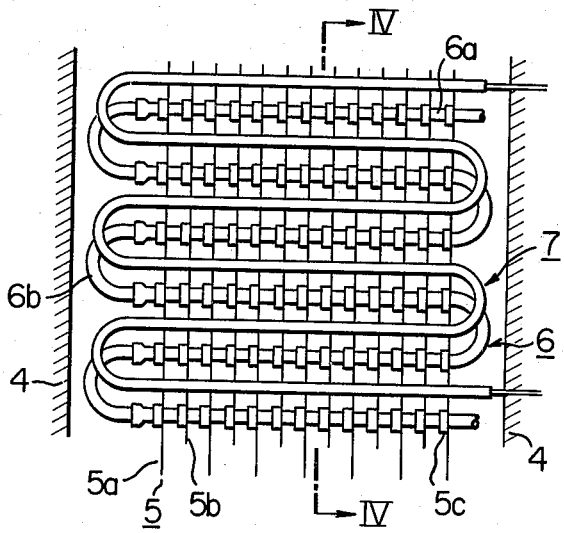
FIG. 3 PRIOR ART
FIG. 3 a front view of a modification of the prior art evaporator shown in FIGS. 1 and 2.
Figure 4:
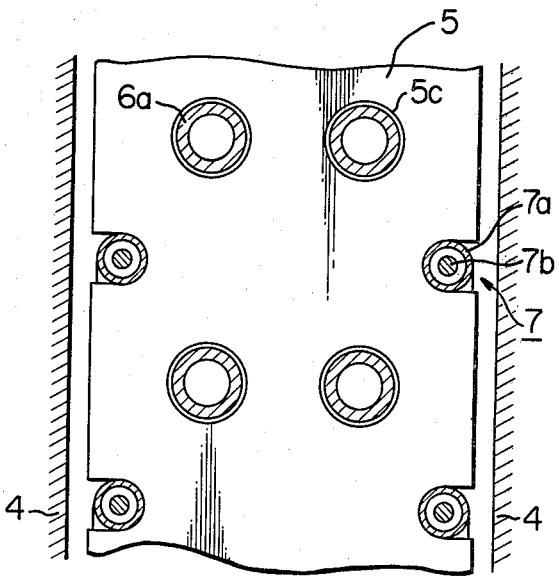
FIG. 4 PRIOR ART
FIG. 4 is a fragmentary sectional view, on an enlarged scale, taken along the line IV—IV in FIG. 3.
Figure 5:
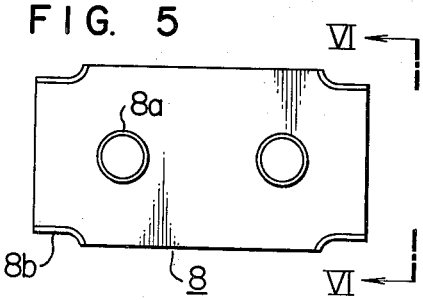
FIG. 5 is a front view of the fin of the evaporator according to the present invention.
Figure 6:
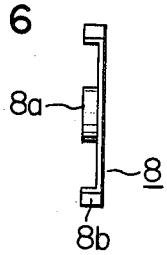
FIG. 6 is a view of the fin as seen in the direction of arrows VI—VI in FIG. 5.
Figure 7:
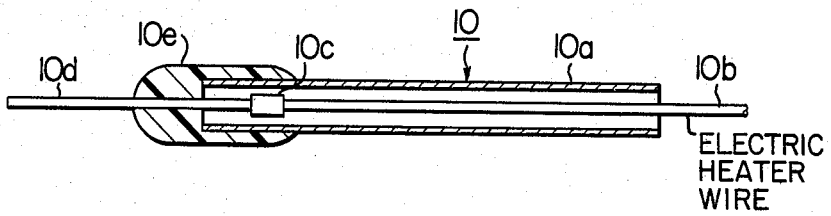
FIG. 7 is a sectional view of an end portion of the heater according to the invention.

A preferred embodiment of the invention will now be described by referring to FIGS. 5 to 11. A fin 8 of a small size is formed with openings each having attached to the edge a cylindrical collar 8*a* for inserting refrigerant tubing 9 therein, and with J-shaped cutouts 8*b* in four corners thereof for supporting a heater 10. The heater 10 includes a heater tube 10*a* enclosing a flexible heater wire 10*b* connected, as shown in FIG. 7, to a lead 10*d* via a connector 10*c*. A sealing material 10*e* is attached by molding to an end portion of the heater tube 10*a*. The numeral 11 designates side plates, and the numeral 12 a duct.

Figure 8:
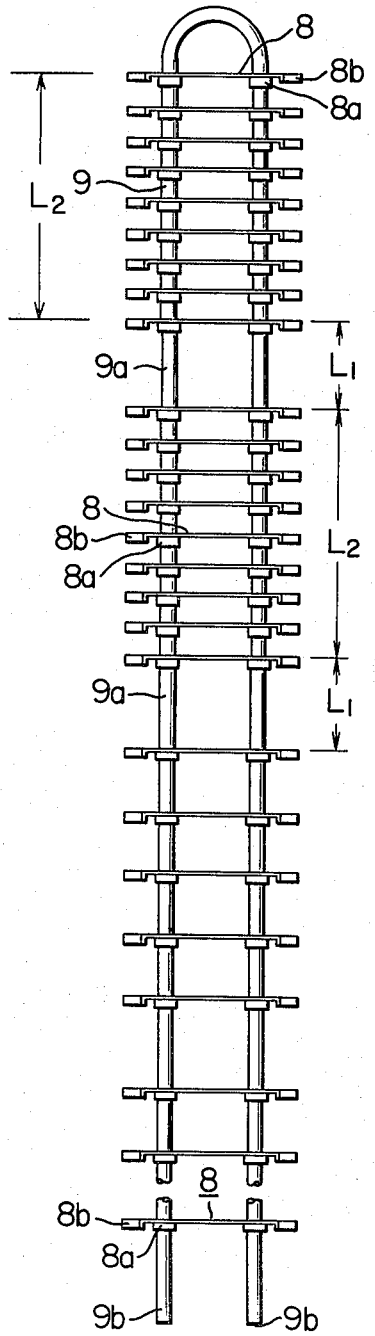
FIG. 8 is a view in explanation of the arrangement of the fins and the manner in which the refrigerant tubing is inserted in the fins according to the invention.
Figure 9:
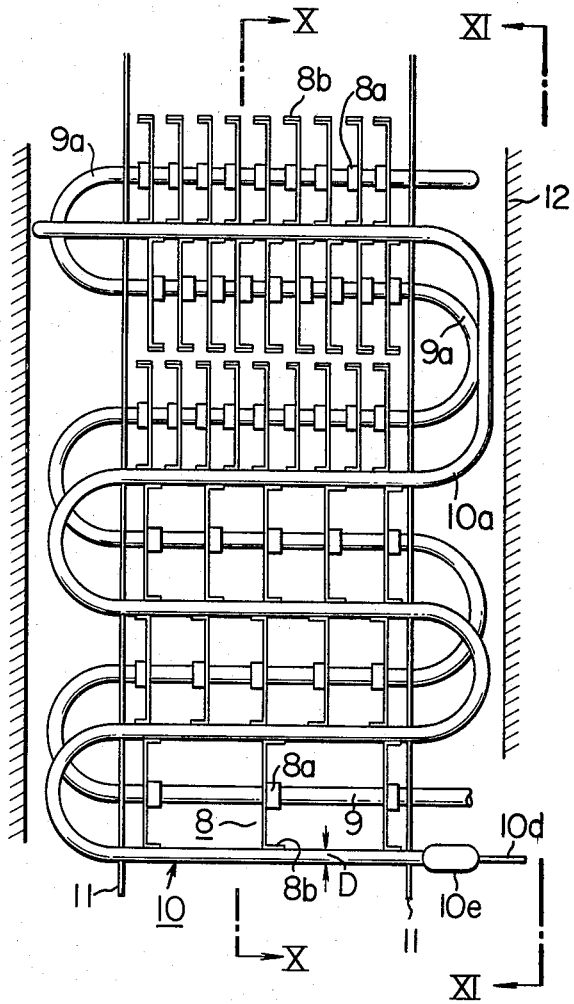
FIG. 9 is a front view of the evaporator comprising one embodiment of the invention.

In assembling the aforesaid parts into an evaporator of a refrigerating apparatus, the fins 8 are arranged parallel to one another, and the refrigerant tubing 9 is inserted in the collars 8*a*. At this time, portions 9*a* of the tubing 9 of a length $L_1$ which are formed into U-shaped bends of the serpentine tube have no fins 8 thereon. More specifically, an array of fins 8 is disposed in portions of a length $L_2$ as shown in FIG. 8.

The fins 8 are located such that the fins of the different arrays differ from one another in spacing interval, so that the fins have a larger spacing interval in an air current inlet portion of the evaporator where a large amount of frost is formed and the fins have a smaller spacing interval in an air current outlet portion of the evaporator where the amount of frost formed is small. This arrangement is conducive to prevent an increase in the resistance offered to the flow of air currents by the frost formation, and enables an overall compact size to be obtained in an evaporator by increasing the heat transfer area in the air current outlet portion.

Thereafter the portions 9*a* of the refrigerant tubing 9 are bent into U-shaped bends so as to form the tubing 9 into a serpentine tube having the fins 8 only on its straight tube portions. The side plates 11 are secured to the U-shaped bends of the refrigerant tubing 9 in serpentine form to ensure that the straight portions of the tubing 9 have a predetermined spacing interval. Then the lead 10*d* is connected to one end of the heater wire 10*b* which is inserted in the heater tube 10*a*. The heater tube 10*a* has a sealing material 10*e* attached to opposite ends thereof by molding to provide the heater 10 which is converted into a serpentine form and inserted in the J-shaped cutouts 3*b* formed at the corners of the adjacent fins 8.

The heater 10 is arranged at higher density in portions of the evaporator where frost is formed in large quantities so as to enable defrosting to be completed uniformly throughout the evaporator. Since the fins 8 of the different arrays are discontinuous with respect to the direction of flow of air currents, it is necessary that the heater 10 be brought into contact with the fins 8 at least in more than one position at each array of fins even in portions of the evaporator where frost formation is small in quantity. It is possible to bring one straight portion of the serpentine heater 10 into contact with two arrays of fins 8.

The heater tube 10*a* has an outer diameter D (see FIG. 10) slightly larger than the distance $L_3$ (see FIG. 10) between the outer edges of the J-shaped cutouts 8*b* of the two adjacent fins 8 so that a clamping force may be produced by flexing of the fins 8 after the assembly has been completed, to thereby reduce contact heat resistance between the heater 10 and fins 8. The heater 10 can be readily removed from the fins 8 for repair and replacements.

Figure 10:
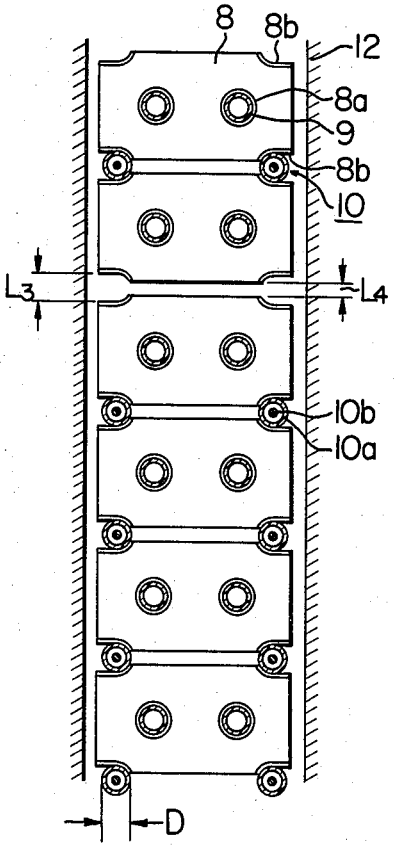
FIG. 10 is a sectional view taken along the lines X—X in FIG. 9.
Figure 11:
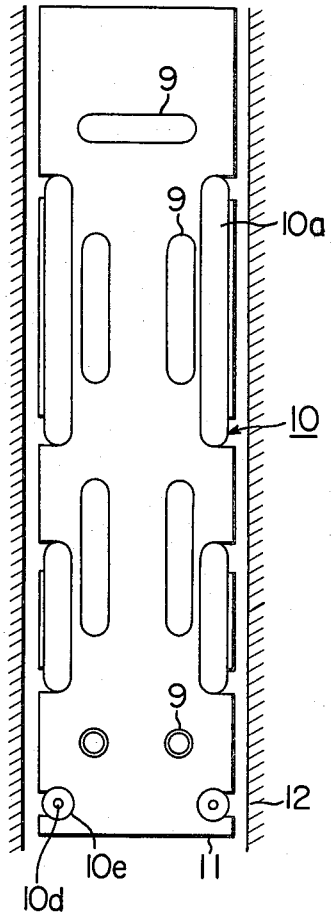
FIG. 11 is a veiw as seen in the direction of arrows XI—XI in FIG. 9.

As shown in FIG. 10, the evaporator is formed of a stacked plurality of side-by-side straight finned tube arrays arranged in the duct 12 with connecting ends 9*b* of the refrigerant tubing 9 being connected to the piping, not shown, of a refrigeration cycle. By driving a refrigerant compressor, not shown, and a blower, not shown, the interior of the refrigerating apparatus can be cooled as the refrigerant is evaporated by the evaporator.

In the evaporator according to the invention, the arrays of fins 8 supported by the straight portions of the serpentine refrigerant tubing 9 are separate from and independent of one another with respect to the directon of flow of air currents, and the rear edge of each fin 8 of one array is spaced apart by a distance $L_4$ from the front edge of each fin 8 of another array. Thus the fresh temperature boundary layer formed at the front end of each fin 8 remains undeveloped, and consequently the temperature gradient within the boundary layer is high, so that the evaporator has a higher mean heat transfer rate than evaporators of the prior art.

The straight portions of the serpentine refrigerant tubing 9 are maintained, at the entire periphery thereof and for a certain length axially thereof, in contact with the cylindrical collars 8*a* attached to the fins 8. Thus the area of contact between the tubing 9 and collars 8*a* of the fins 8 is large, and the contact pressure between the tubing 9 and collars 8*a* can be increased by force fitting the tubing 9 into the collars 8*a*. This is conducive to reduced contact heat resistance and increased cooling capabilities.

The array of fins 8 in the air current inlet portion of the evaporator where frost formation is large in amount has a larger spacing interval between the fins 8 than the array of fins 8 in the air current outlet portion thereof where frost formation is small in amount. This arrangement makes thermal capacity of the evaporator uniform, so that the arrangement of the heater 10 can be rendered rather uniform without being confined to the air current inlet portion. This avoids the danger of overheating when defrosting is effected when frost is small in amount. In addition, the feature that the contact pressure between the fins 8 and heater 10 is high is conducive to increased efficiency of defrosting and prevention of heating the heater tube 10*a*. Thus it is possible to avoid deterioration of the preserved foodstuffs due to a rise in temperature and damage to the heater 10 caused by overheating.

In the constructional and structural aspects, the cutouts formed in the fins according to the invention are smaller in area than the U-shaped notches formed in the fins of the prior art, thereby enabling economization on material costs to be achieved to reduce production costs. This also permits a reduction in the heat transfer area of the fins to be minimized, and allows the fins to be arranged in a manner to be commensurate with the distribution of frost formation by merely varying the spacing intervals of the arrays of fins in accordance with the positions of the fins in the evaporator, in spite of the fact that the fins used are only of one type. The fins are smaller in size than those of the prior art and can be worked with ease. Assembling of the fins on the refrigerant tubing can be automated, and the steps of fabrication of the evaporator can be minimized. Besides, the refrigerant tubing requires no welding more than is necessary, and this is conducive to elimination of the potential cause of leakage of the refrigerant.

From the foregoing description, it will be appreciated that the refrigerant tubing of the evaporator according to the invention extends through the cylindrical collars attached to the edges of openings formed in the fins, so that a loss of the heat transfer area due to stamping of the fins can be minimized and the area of contact between the refrigerant tubing and the fins can be increased. Thus the evaporator has low contact heat resistance and high heat transfer capabilities. The refrigerant tubing is formed into a serpentine form by mounting the arrays of fins on the parallel straight portions alone of the tubing without mounting any fins on the U-shaped bends at opposite end portions of the serpentine tubing. This feature eliminates the need to join U-shaped tubes to straight tubes by welding in forming a serpentine tube as in the prior art, thereby greatly increasing operation efficiency and reliability in performance of the evaporator.

The fins are smaller in size and an array of such small fins is mounted on each straight portion of the refrigerant tubing of serpentine form so that the adjacent arrays of fins are separate from and independent of one another. This feature enables the center value of the heat transfer area from the air current inlet portion to the air current outlet portion to be reduced, so that growth of the temperature boundary layers in the air current outlet portion can be prevented and the average heat transfer rate can be greatly increased. The fins are each formed with heater supporting cutouts in four corners thereof, and the heater is inserted in the cutouts of the adjacent fins in thermal contact therewith, so that arranging of the heater is facilitated and the heater can be readily removed for repair or replacements.

What is claimed is:

1. An evaporator of a refrigerating apparatus comprising:

a refrigerant tube of serpentine form including a plurality of finned parallel straight portions connected together in series flow relationship by U-shaped unfinned connecting end portions and arranged to form a stacked assembly of side-by-side finned tube arrays, each tube array including a plurality of generally rectangular fins of a small size, each of the rectangular fins being formed with openings having cylindrical collars attached to edges of the openings for allowing said straight portions of said refrigerant tube to extend therethrough, said fins each being formed with heater supporting cutouts in four corners thereof, the cutouts at confronting corners of the fins of each immediately adjacent pair of finned tube arrays being juxtaposed to define a heater receiving space extending a length of the finned tube arrays; and an elongated heater supported by said juxtaposed heater supporting cutouts of the fins of a pair of immediately adjacent finned tube arrays in the stack and in thermal contact with the fins, said heater being substantially coextensive in length with the length of the tube arrays.

2. An evaporator as claimed in claim 1, wherein the stacked assembly of finned tube arrays is arranged in a duct having an air inlet and an air outlet, the finned tube arrays extending substantially transversely to a direction of air flow through the duct, said fins having a larger spacing interval near the air inlet and a smaller spacing interval near the air outlet.

3. An evaporator as claimed in claim 2 wherein the heater includes a serpentine tube having a larger number of tube portions located near the air inlet than near the air outlet, and wherein the fins each have at least two corners in contact with the heater.

4. An evaporator of a refrigerating apparatus comprising:

an assembly of a stacked plurality of side-by-side straight finned tube arrays, each finned tube array comprising at least one straight elongated refrigerant tube and a plurality of spaced rectangular fins extending transversely of the at least one straight refrigerant tube along the entire length thereof, the straight refrigerant tubes of the stacked finnec tube arrays have ends thereof connected to each other by unfinned U-shaped tube portions to form a continuous refrigerant flow path from a refrigerant inlet at the end of one straight tube to a refrigerant outlet at an end of another straight tube, said fins comprising a plurality of fins of a small size each formed with openings having cylindrical collars attached to their edges for allowing said refrigerant tube to extend therethrough, said fins being arranged in arrays mounted only on parallel straight portions of said refrigerant tube without any fins being mounted on U-shaped end portions of the refrigerant tube, said fins each being formed with heater supporting cutouts in four corners thereof, the side edges of the fins in each finned tube array being co-planar with side edges of the fins in each immediately adjacent finned tube array in the stack, upper and lower edges of the fins of each finned tube array being spaced from confronting edges of the immediately adjacent finned tube arrays in the stack, the corners of each rectangular fin of each finned tube arrang being provided with a J-shaped cutout, and the J-shaped cutouts in each pair of juxtaposed corners of immediately adjacent pairs of finned tube arrays cooperating to form a U-shaped space extending the length of the finned tube arrays and adapted to clampingly receive an elongated straight defroster heater in good heat conductive contact with each fins of the immediately adjacent pair of finned tube arrays; and an elongated straight electric defroster heater received in at least one of the U-shaped spaces for enabling a defrosting of the apparatus.

5. An evaporator as claimed in claim 4, wherein the assembly is arranged in a duct having an air inlet and an air outlet, with the finned tube arrays extending transversely to a direction of air flow through the duct and with the fins of each array arranged parallel to the air flow through the duct, the fins on the finned tube array nearest the air inlet of the duct being spaced at greater intervals than the fins on the array immediately adjacent to the air outlet of the duct so as to preclude a restriction of air flow due to greater frost formation on the fins of the array immediately adjacent to the air inlet of the duct.

6. An evaporator as claimed in claim 5, wherein the heater includes a serpentine tube, the fins each have at least two corners in contact with the heater, the heater being an elongated tube bent in serpentine formation as a series of elongated straight portions joined at respective ends by U-shaped portions to form a continuous heater, the straight portions being received in different ones of the U-shaped elongated spaces formed by the J-shaped cutouts at juxtaposed corners of adjacent finned tube arrays, and the heater being distributed along the assemblies such that there are more straight heater portions in contact with finned tube arrays adjacent the air inlet of the duct then there are in contact with finned tube arrays adjacent to the air outlet of the duct.

* * * * *